US010244829B2

(12) United States Patent
Meehan et al.

(10) Patent No.: US 10,244,829 B2
(45) Date of Patent: Apr. 2, 2019

(54) ZIPPER LOCK

(71) Applicant: JUNO GROUP PTY LTD, Balgowlah (AU)

(72) Inventors: Nadine Meehan, Balgowlah (AU); Annette Katelaris, Balgowlah (AU)

(73) Assignee: Juno Group Pty Ltd, Balgowlah New South Wales (AU)

( * ) Notice: Subject to any disclaimer, the term of this patent is extended or adjusted under 35 U.S.C. 154(b) by 0 days.

(21) Appl. No.: 15/102,088

(22) PCT Filed: Dec. 4, 2014

(86) PCT No.: PCT/AU2014/001102

§ 371 (c)(1),
(2) Date: Jun. 6, 2016

(87) PCT Pub. No.: WO2015/081380

PCT Pub. Date: Jun. 11, 2015

(65) Prior Publication Data

US 2016/0316861 A1 Nov. 3, 2016

(30) Foreign Application Priority Data

Dec. 4, 2013 (AU) ..... 2013904711

(51) Int. Cl.

| | |
|---|---|
| ***A44B 19/00*** | (2006.01) |
| ***A44B 19/30*** | (2006.01) |
| ***A44B 19/26*** | (2006.01) |
| ***B65D 33/25*** | (2006.01) |
| ***B65D 33/32*** | (2006.01) |

(52) U.S. Cl.

CPC ..... *A44B 19/303* (2013.01); *A44B 19/262* (2013.01); *A44B 19/301* (2013.01); *B65D 33/2591* (2013.01); *B65D 33/32* (2013.01)

(58) Field of Classification Search

CPC ... A44B 19/301; A44B 19/303; A44B 19/262; Y10T 24/2511; Y10T 24/2532; Y10T 70/5053; B65D 33/2591

USPC ..... 383/61.2, 61.3, 63, 64

See application file for complete search history.

(56) References Cited

U.S. PATENT DOCUMENTS

| | | | | |
|---|---|---|---|---|
| 2,569,076 A * | 9/1951 | Schaye | ..... | A44B 19/301 24/387 |
| 2,826,797 A * | 3/1958 | Reeves | ..... | A44B 19/301 24/387 |
| 3,759,073 A * | 9/1973 | Rifkin | ..... | A44B 19/301 24/387 |

(Continued)

FOREIGN PATENT DOCUMENTS

| | | |
|---|---|---|
| EP | 0402949 | 5/1994 |
| WO | 2009112078 | 9/2009 |

OTHER PUBLICATIONS

International Search Report for Application No. PCT/AU2014/001102 dated Feb. 17, 2015 (5 pages).

*Primary Examiner* — Peter N Helvey
(74) *Attorney, Agent, or Firm* — Michael Best & Friedrich LLP

(57) ABSTRACT

A lock for a zipper, the zipper comprising a chain and a slider, the chain being moveable to adopt an open and a closed configuration through movement of the slider with respect to the chain, the lock adapted to retain the slider with respect to the chain by abutting a surface of the slider.

14 Claims, 23 Drawing Sheets

(56) References Cited

U.S. PATENT DOCUMENTS 3,852,851 A * 12/1974 Higuchi ..... A44B 19/301 24/387
3,971,458 A * 7/1976 Koenig ..... A44B 19/301 190/120
3,991,444 A * 11/1976 Bailey ..... B65D 63/1063 24/16 PB
4,112,990 A * 9/1978 Anderson ..... A44B 19/301 292/282
4,236,280 A * 12/1980 Kreiseder ..... B65D 63/1072 24/16 PB
4,815,176 A * 3/1989 Yoshida ..... A44B 19/262 24/387
4,890,935 A * 1/1990 Ausnit ..... A44B 19/301 24/390
4,930,323 A * 6/1990 Terada ..... A44B 19/301 70/68
5,081,855 A * 1/1992 Terada ..... A44B 19/301 70/68
5,195,221 A * 3/1993 Kanamaru ..... A44B 19/26 24/419
5,681,115 A 10/1997 Diederich et al.
6,286,999 B1 * 9/2001 Cappel ..... B65D 33/065 24/400
6,385,818 B1 * 5/2002 Savicki, Sr. ..... B65D 33/2591 24/30.5 R
6,442,804 B2 * 9/2002 Turvey ..... B65D 33/2591 24/390
6,526,632 B1 * 3/2003 Blythe ..... B65D 33/2591 24/388
6,533,335 B2 * 3/2003 Hudson ..... A44B 19/301 190/903
7,159,282 B2 * 1/2007 Blythe ..... B65D 33/2591 24/400
9,126,724 B2 * 9/2015 VanLoocke ..... B65D 33/2591
2002/0070566 A1 6/2002 Hudson

* cited by examiner

SECTION C-C

Fig. 20
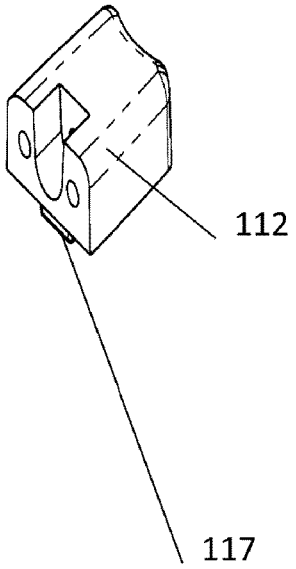
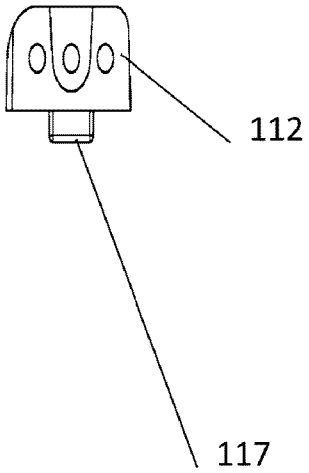
Fig. 21
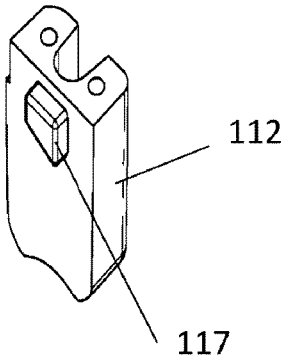
Fig. 22

SECTION B-B

ZIPPER LOCK

TECHNICAL FIELD

The present invention relates generally to devices for locking zippers. In particular, the invention is directed to a lock for a receptacle with a zippered closure. This is particularly useful in circumstances where safety concerns necessitate obstructing a child from gaining access to the receptacle, such as, for example when medications are to be carried. However, it is to be appreciated that the invention has broader application and may be utilised in other applications where locking a zipper is of benefit.

BACKGROUND OF THE INVENTION

Safety and protection from accidental opening particularly by a child is paramount in considering medications and other dangerous substances. While sometimes it is suitable to position medications and other substances out of reach, such as in a lock box or high shelf, it can be particularly difficult to maintain safety when carrying medications or other potentially dangerous substances on one's person or in one's bag or car.

A reference herein to prior art is not an admission that the prior art forms part of the common general knowledge of a person of ordinary skill in the art in Australia or elsewhere.

SUMMARY OF THE INVENTION

In a first aspect, disclosed is a lock for a zipper, the zipper comprising a chain and a slider, the chain being moveable to adopt an open and a closed configuration through movement of the slider with respect to the chain, the lock adapted to retain the slider with respect to the chain by abutting a surface of the slider.

In a second aspect disclosed is a lock for a zipper as defined in any of the preceding claims, the lock being adapted for use with a zippable receptacle having an inside and an outside, the slider being positioned such that an inner surface of the slider faces inwardly with respect to the receptacle, the lock being adapted to retain the slider through contact with the inner surface.

In a third aspect disclosed is a receptacle having a zipper adapted to close the receptacle and a zipper lock, the zipper comprising a chain and a slider, the chain being moveable to adopt an open and a closed configuration through movement of the slider with respect to the chain, the lock adapted to retain the slider with respect to the chain by abutting a surface of the slider.

In a fourth aspect, disclosed is a receptacle having a zipper adapted to close the receptacle and a zipper lock, the zipper lock including a locking member which is positioned inside the receptacle.

These aspects of the invention allow for locking of a zipper to protect from opening by a small child while providing for simple access without requiring the complication of keys or codes. In some forms the lock is positioned interior to the receptacle which limits the ability of a child to pass the lock without utilising the child safe actuator.

In some forms the lock and receptacle configuration allows for the lock to be opened by persons with limited manual dexterity while still precluding opening by small children. In some forms the lock and receptacle are particularly suited for applications where carrying the receptacle such as, for example, in a hand bag, backpack or pocket is beneficial.

DESCRIPTION OF THE DRAWINGS

It is convenient to hereinafter describe an embodiment of the present invention with reference to the accompanying drawings. It is to be appreciated however that the particularity of the drawings and the related description is to be understood as not limiting the preceding broad description of the invention.

In the drawings:

FIG. 20 is a perspective view of an actuator button of a lock;

FIG. 21 is a side view of the actuator button of FIG. 20;

FIG. 22 is an angled perspective view of the actuator button of FIG. 20;

DETAILED DESCRIPTION OF THE DRAWINGS

Figure 1:
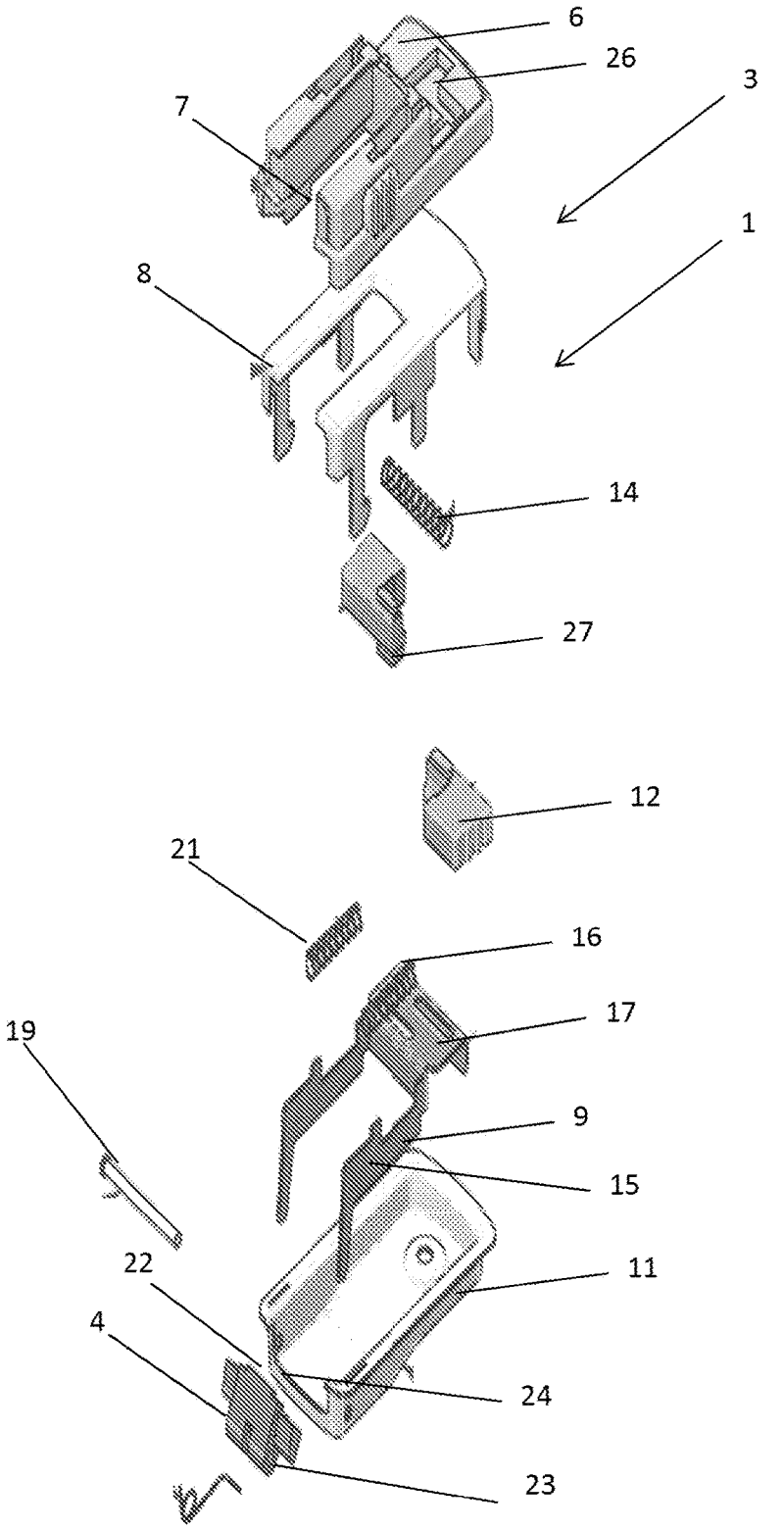
FIG. 1 is an exploded view of a lock of a first embodiment of the disclosure.

Disclosed in some forms is a lock for a zipper, the zipper comprising a chain and a slider, the chain being moveable to adopt an open and a closed configuration through movement of the slider with respect to the chain, the lock adapted to retain the slider with respect to the chain by abutting a surface of the slider.

In some forms the lock comprises a locking member which is moveable between a retaining position in which a portion of the locking member is configured to abut a surface of the slider and a releasing position.

In some forms the locking member is hingedly moveable between the retaining position and the releasing position.

In some forms movement between the retaining position and the releasing position is effected by an actuator.

In some forms the actuator comprises a child-safe actuator.

In some forms the actuator requires compression of multiple actuator portions to result in movement of the shoulder between the retaining position and the releasing position.

In some forms the zipper comprises a pull tab engaged with the slider for effecting movement of the slider with respect to the chain, the slider having opposing sides, the lock adapted to retain the slider with respect to the chain by abutting a surface of the slider opposing a surface to which the pull tab is engaged.

In some forms the lock includes an abutment face extending substantially perpendicular to the direction of movement of the slider.

In further embodiments disclosed is a lock for a zipper as defined in any of the preceding claims, the lock being adapted for use with a zippable receptacle having an inside and an outside, the slider being positioned such that an inner surface of the slider faces inwardly with respect to the receptacle, the lock being adapted to retain the slider through contact with the inner surface.

In some forms the zipper comprises a chain and a slider, the chain being moveable to adopt an open and a closed configuration through movement of the slider with respect to the chain, the lock comprising a locking member positioned in the interior of the receptacle.

In some forms the locking member is moveable between a retaining position and a releasing position and is adapted to abut a surface of the slider in the retaining position.

In some forms the locking member is moveable between the retaining position and the releasing position by use of an actuator.

In some forms the actuator is configured to be child-safe.

Further disclosed is a receptacle having a zipper adapted to close the receptacle and a zipper lock, the zipper comprising a chain and a slider, the chain being moveable to adopt an open and a closed configuration through movement of the slider with respect to the chain, the lock adapted to retain the slider with respect to the chain by abutting a surface of the slider.

In some forms the lock comprises a shoulder which is moveable between a retaining position in which the shoulder is configured to abut a surface of the slider and a releasing position.

In some forms movement between the retaining position and the releasing position is effected by an actuator.

In some forms the actuator comprises a child-safe actuator.

In a further embodiment, disclosed is a receptacle having a zipper adapted to close the receptacle and a zipper lock, the zipper lock including a locking member which is positioned inside the receptacle.

In some forms the zipper comprises a chain and a slider, the chain being moveable to adopt an open and a closed configuration through movement of the slider with respect to the chain, the locking member being adapted to abut a surface of the slider in the retaining position.

In some forms the locking member is moveable between the retaining position and the releasing position by use of an actuator.

In some forms the receptacle is a bag for carrying medication or other hazardous products.

In some forms the receptacle is sized for fitting within a carry bag, hand bag, back pack or other bag.

Figure 2:
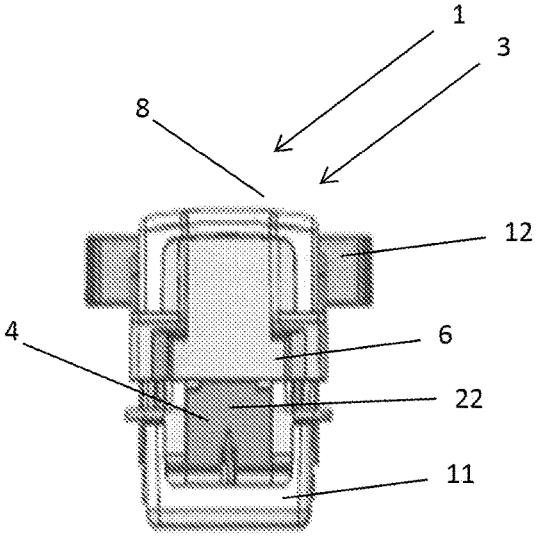
FIG. 2 is a front view of the lock of FIG. 1.
Figure 3:
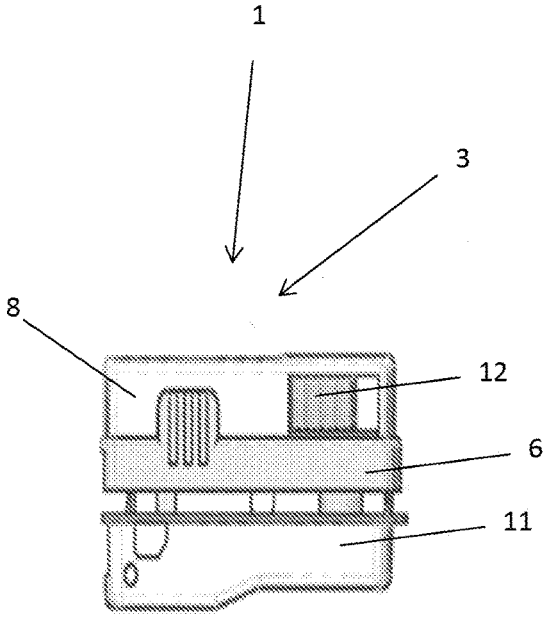
FIG. 3 is a side view of the lock of FIG. 1.
Figure 4:
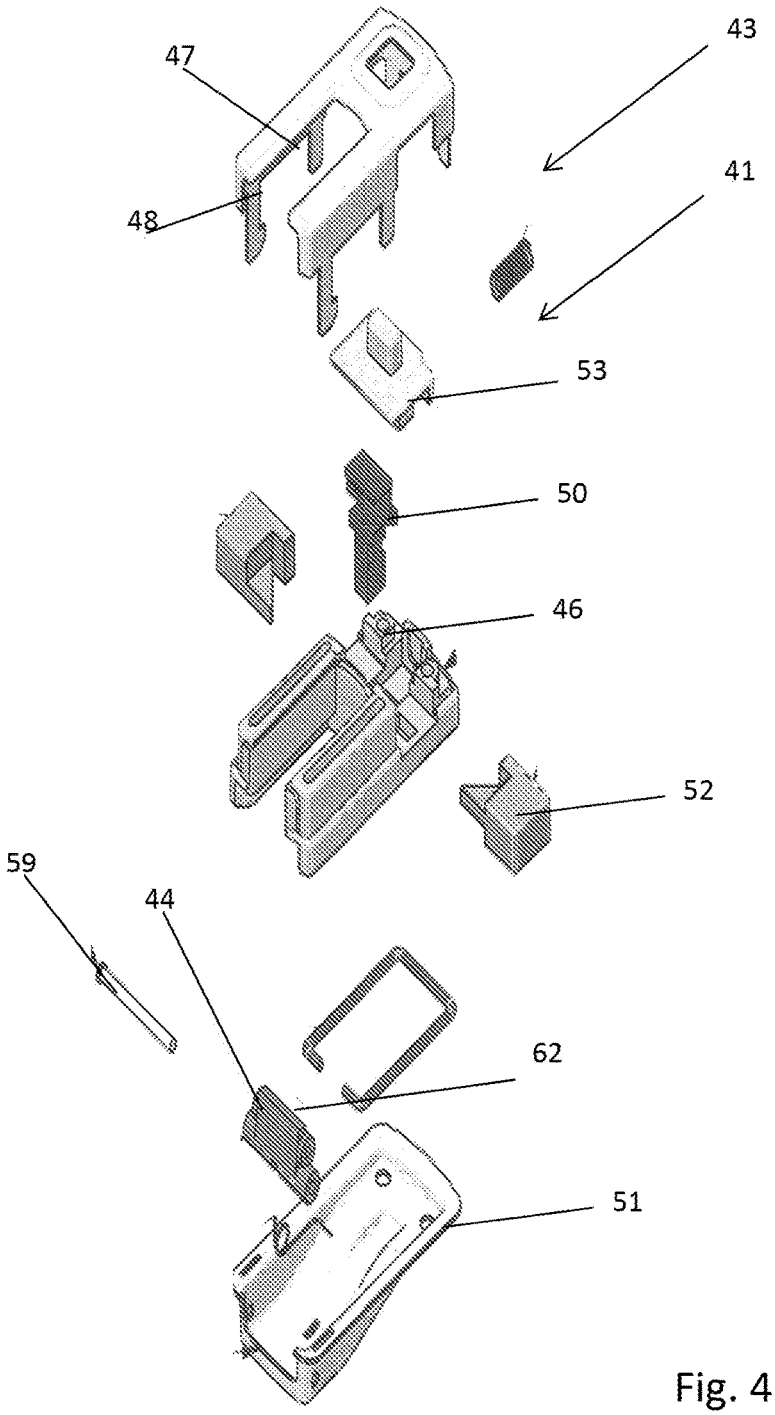
FIG. 4 is an exploded view of a lock of a second embodiment of the disclosure.
Figure 5:
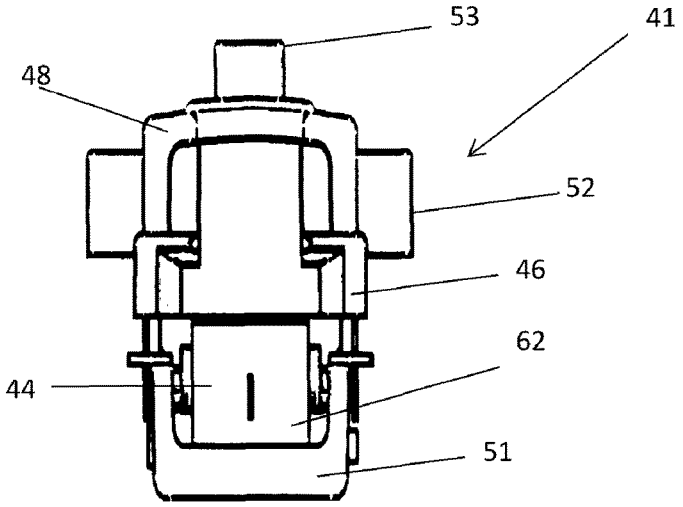
FIG. 5 is a front view of the lock of FIG. 4.
Figure 6:
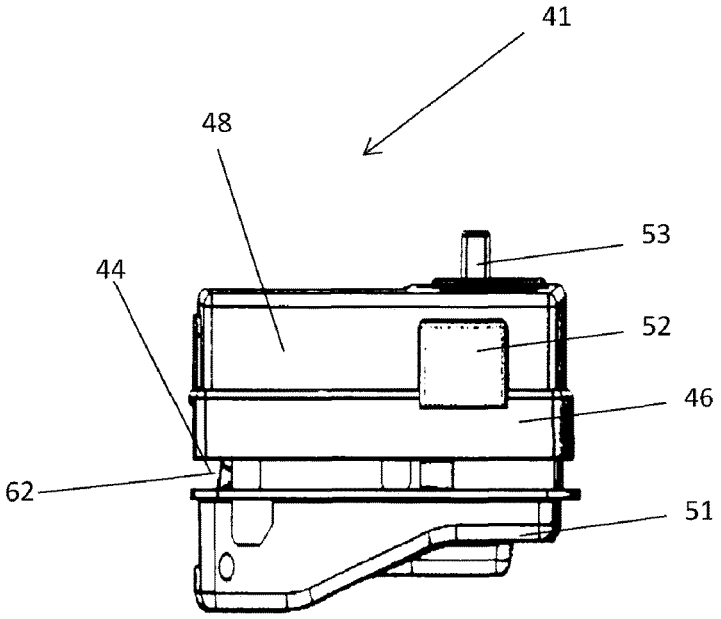
FIG. 6 is a side view of the lock of FIG. 4.

Turning now to FIGS. 1-3, disclosed is a lock 1 for a zipper (not illustrated). The lock 1 is adapted to retain a slider (not illustrated) in relation to a chain (not illustrated) of the zipper in order to maintain the zipper in a closed configuration until the lock 1 is actuated for opening. The lock is particularly useful in applications in which the zipper is designed to close a receptacle such as a bag, an envelope or a box.

The lock 1 comprises a lock body 3 and a locking member 4. In the illustrated form the lock body 3 comprises a chassis 6 defining an internal cavity 7. A cover 8 is configured and shaped to fit over the chassis and further define the internal cavity 7. A slider assembly 9 extends through and is supported by the chassis 6 and a base 11.

The lock body further comprises two actuator buttons 12 which are configured to be positioned to extend through the cover 8 and engage with the slider assembly 9 to actuate the arms 15. The actuator buttons 12 are outwardly biased by a spring 14 extending between them.

Chassis 6 includes a slot 26 in its outwardly facing surface. The slot 26 includes a central slot 28 and two side extensions 29. The slot 26 is sized such that in use lugs 27 extending inwardly from the actuator buttons 12 can be located in the slot 26. The lugs 27 are located in the side extensions 29 when the actuator buttons are released and move into the central slot 28 when the actuator buttons 12 are pressed. This provides for safety from accidental opening for example by a child. When the lugs 27 face into and are located in the slot 26 the slider assembly 9 and arms 15 cannot be moved longitudinally with respect to the lock (to release or open the lock) until the actuator buttons 12 are pressed in. Once the actuator buttons 12 are pressed, the lugs 27 align in the centre slot allowing the slider assembly 9 to be moved.

The slider assembly 9 comprises arms 15 which are biased into position by a set of springs 16 and an adjoining web 17. The slider assembly 9 is the unlocking member and is configured to engage with and act upon the locking member 4.

The locking member 4 is rotatably supported by a lock pin 19. In the illustrated form the locking member 4 extends between the arms 15. The locking member 4 is in the form of a rotatable shoulder 22. The shoulder 22 is rotatable between an upstanding position which forms the retaining position of the lock. The shoulder 22 is biased into this retaining position by a spring 23.

The shoulder 22 is moveable into a releasing position in which the shoulder is positioned proximally to the base 11 rather than in an upstanding position.

In use, a zipper is located within the lock 1 such that a terminal portion of the chain is located in the internal cavity. The chain is retained in position by the chassis 6. A zipper slider portion of the zipper is moveable into the internal cavity 7. When the zipper slider is positioned in the internal cavity 7 the zipper is in a closed configuration.

The locking member 4 of lock 1 is biased into an upstanding position in which the slider is retained in position within the lock 1. In use, a pull tag (not illustrated) of the slider is positioned and accessible within the internal cavity 7. However the locking member 4 precludes movement of the slider in response to pulling the pull tab until the lock is unlocked.

Actuation of the lock 1 results in movement of the lock member 4 into a releasing position in which the zipper slider is moveable with respect to the chain to open the zipper.

In the illustrated form, the retaining position of the locking member 4 is such that the slider cannot move from the lock 1 because a surface of the slider cannot be moved past the shoulder 22. The shoulder 22 thus abuts a surface of the slider, preventing motion. Specifically the shoulder in the illustrated form abuts a surface of the slider in an opposing relationship with the pull tab. The locking member 4 further includes outwardly pointing lugs 23 which allow the locking member 4 to move back into the open position when actuated by arms 15.

The lock 1 includes the further safety feature that rotation of the locking member 4 without actuation by the arms 15 results in the locking member 4 abutting a forward shoulder 24 of the base 11. This means the locking member 4 cannot be easily moved into the open position by a child.

In use on a receptacle, the locking member 4 is positioned internal to the receptacle. As a result the locking member abuts an internal side of the slider.

Turning to the second embodiment shown in FIGS. 4-7, disclosed is a lock 41 comprising a lock body 43 and a locking member 44.

The lock body 43 comprises a chassis 46, defining an internal cavity 47. The chassis 46 is shaped to fit a drive 50 and actuators 52. A cover 48 is configured to fit over the chassis 46 and retain a safety switch 53 extending through the cover. A release link 58 extends through the chassis and links the drive 50 to the locking member 44. A base 51 supports the chassis and the locking member 44 by means of a lock pin 59 which extends through the locking member 44 into the base 51

Figure 7:
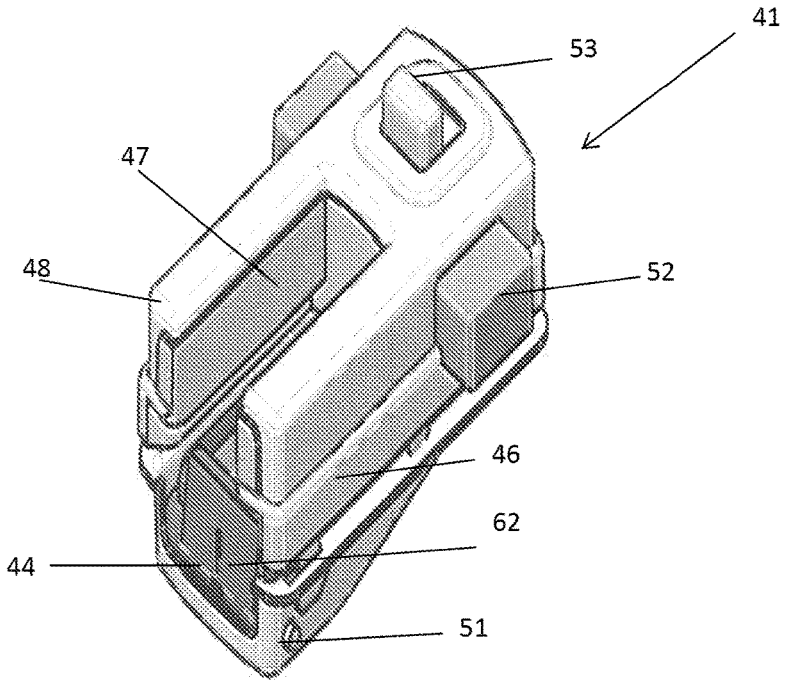
FIG. 7 is a perspective view of the lock of FIG. 4.
Figure 8:
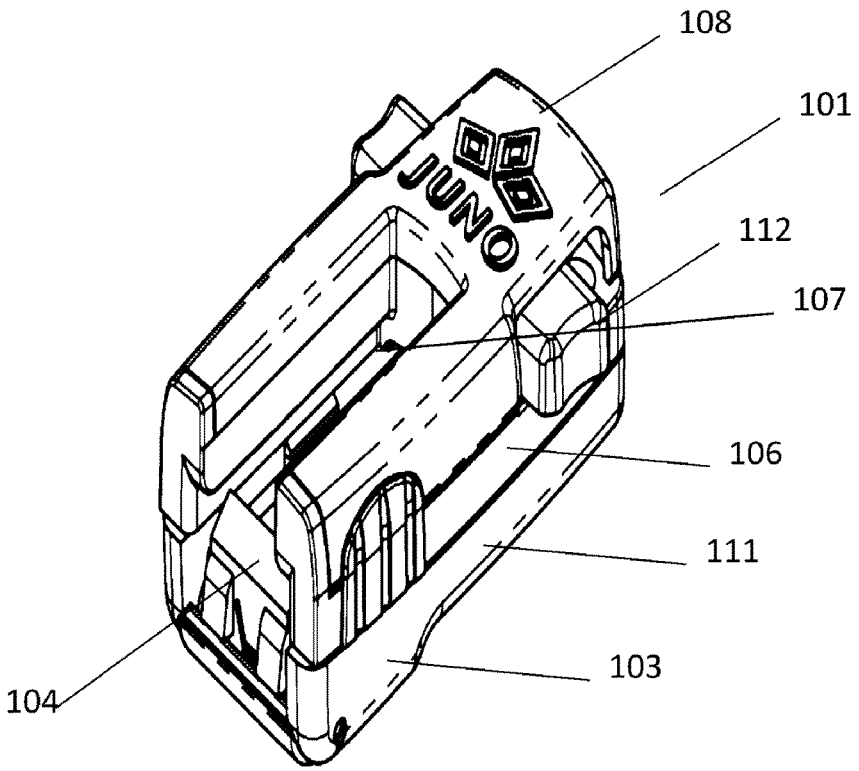
FIG. 8 is a perspective view of a lock of a second embodiment of the disclosure.
Figure 9:
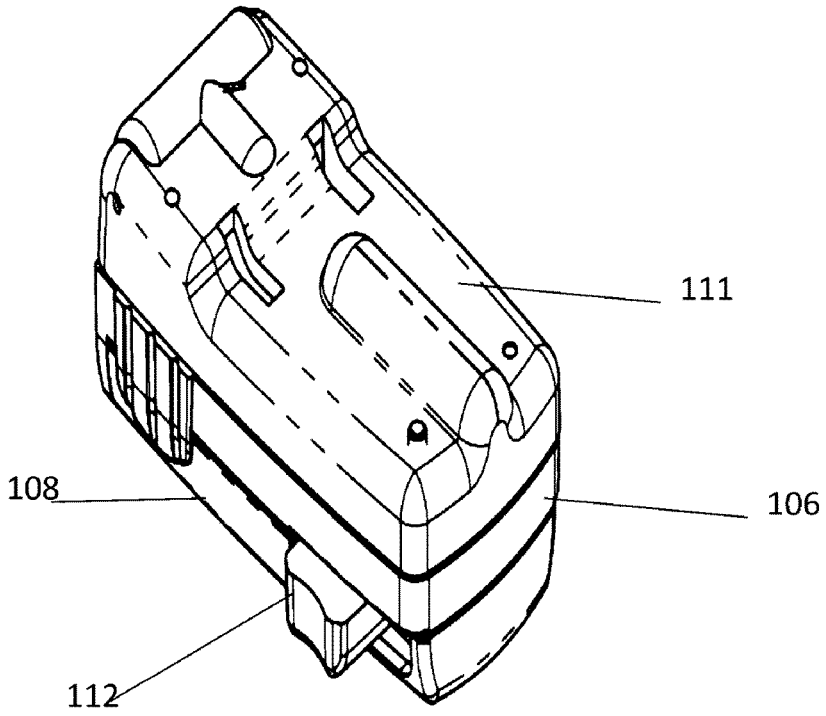
FIG. 9 is a bottom perspective view of the lock of FIG. 8.
Figure 10:
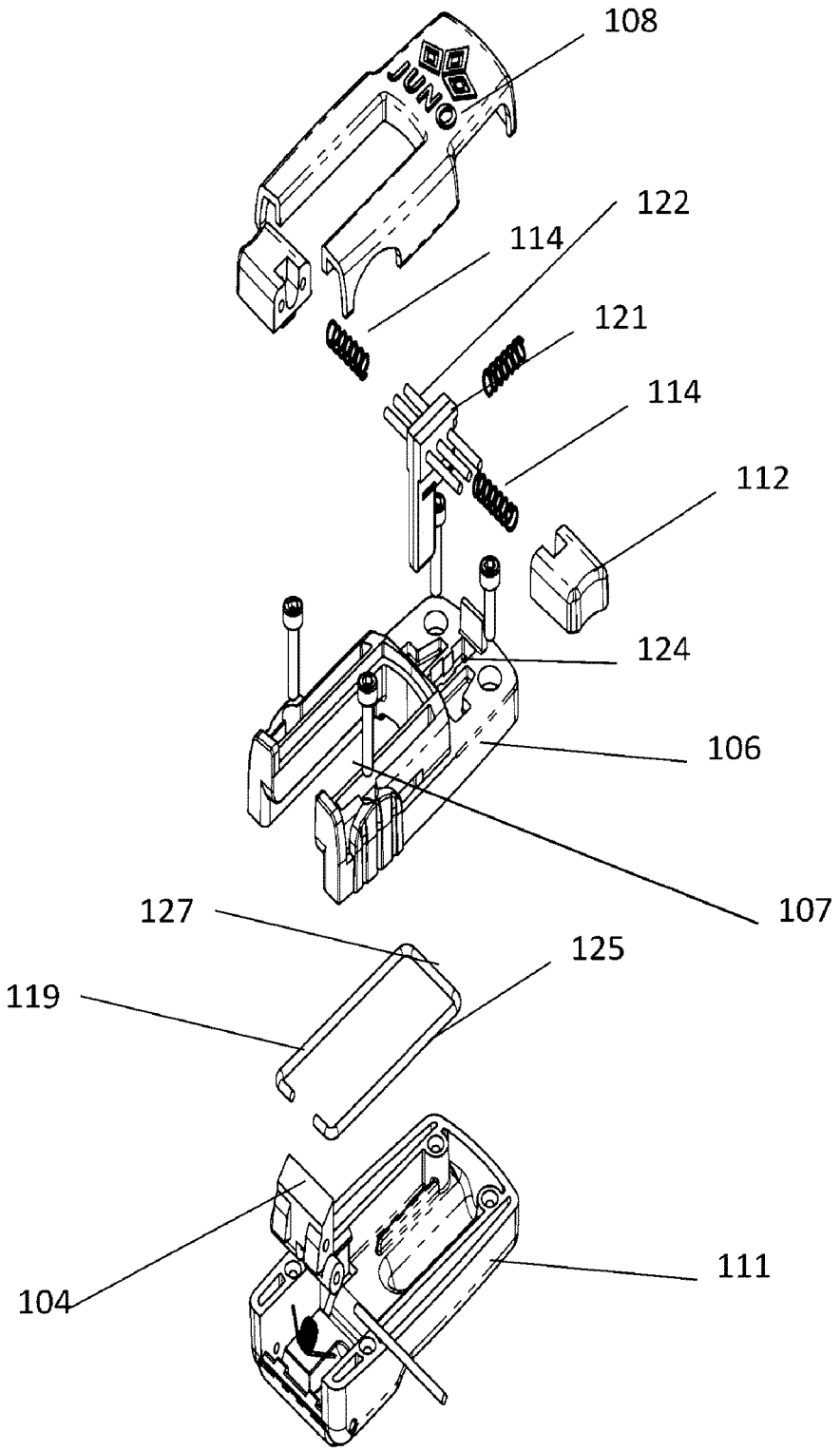
FIG. 10 is an exploded view of the lock of FIG. 8.
Figure 11:
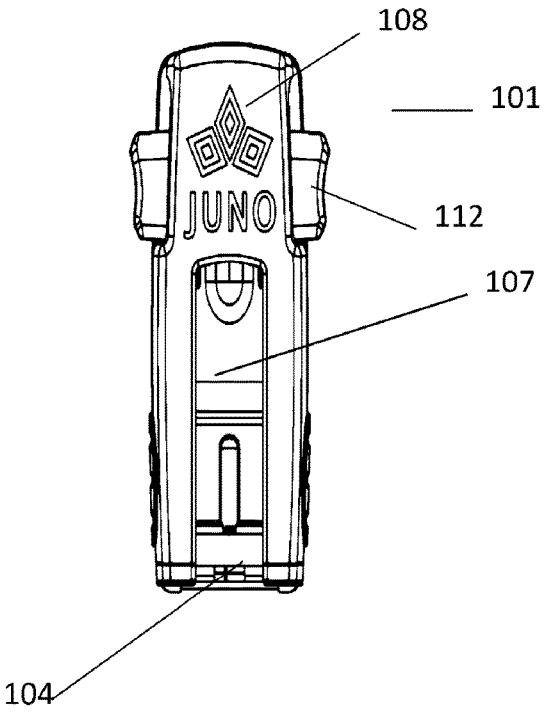
FIG. 11 is a top view of the lock of FIG. 8.
Figure 12:
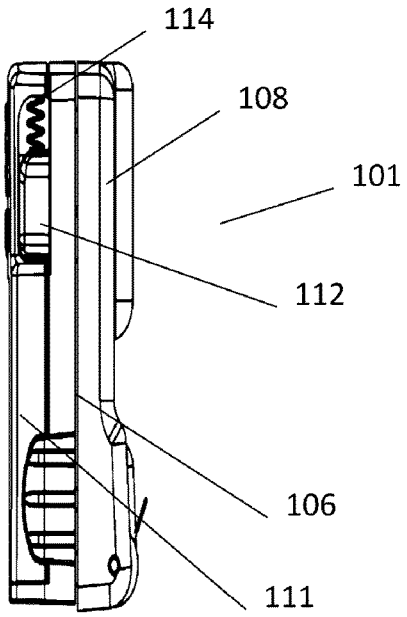
FIG. 12 is a side view of the lock of FIG. 8.
Figure 13:
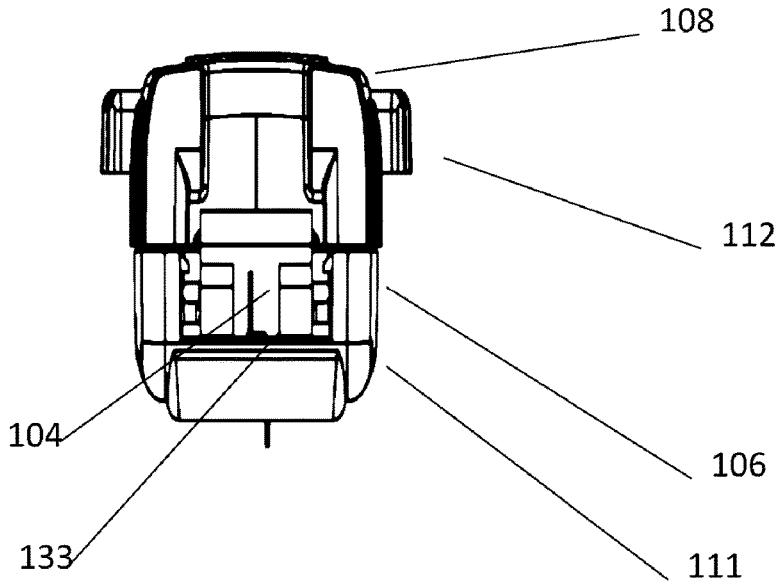
FIG. 13 is an end view of the lock of FIG. 8.
Figure 14:
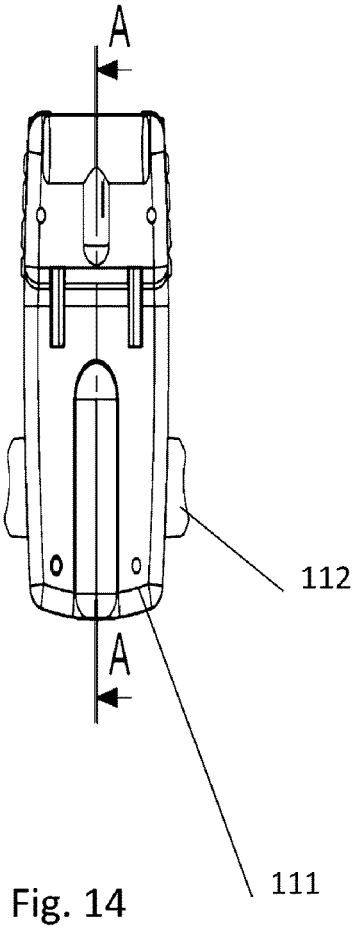
FIG. 14 is a bottom view of the lock of FIG. 8.
Figure 15:
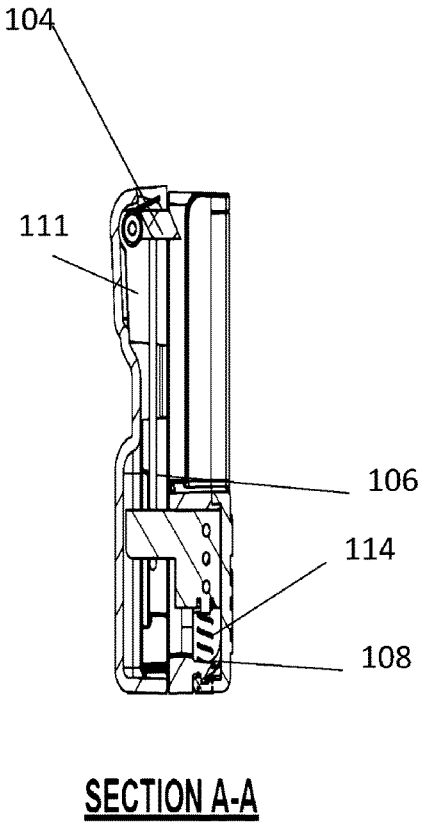
FIG. 15 is a cross-sectional view through A-A of the lock of FIG. 8.
Figure 16:
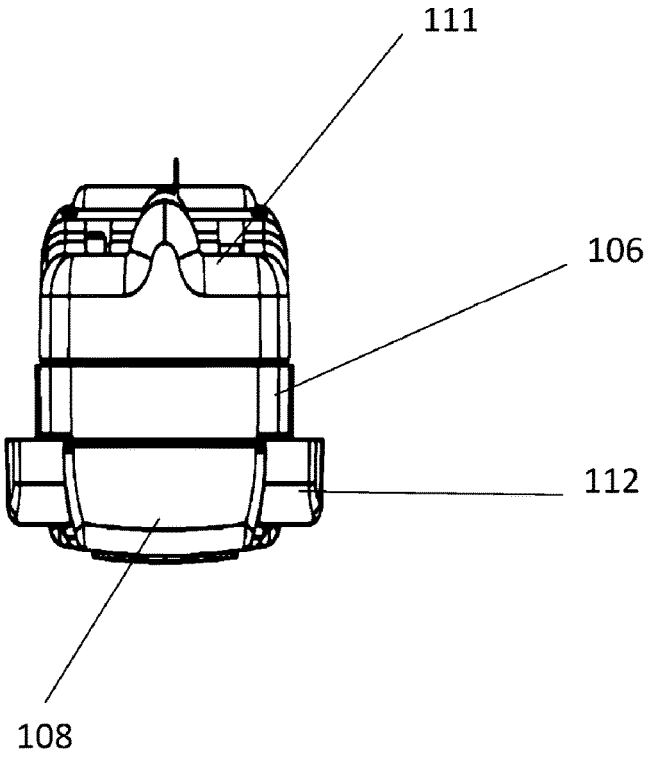
FIG. 16 is an end view of the lock of FIG. 8.

The locking member 44 is in the form of a rotatable shoulder 62, rotatable between an upstanding position as shown in FIG. 7 which forms the retaining position and a release position (not illustrated) in which the shoulder extends substantially parallel with or aligned to the base 51. The shoulder rotated about lock pin 59 between these positions. The shoulder 62 is biased into the retaining position by a spring 63.

In use, a zipper (not illustrated) is positioned within the lock such that the pull tab of the slider extends from the internal cavity. The locking member 44 is biased into an upstanding position in which movement of the slider is prevented by contact between a surface of the slider facing away from the pull tab and the shoulder 62.

Actuation of the actuators 52 result in the drive 50 rotating to move the release link and compel the shoulder 62 to move into the release position to allow the slider to move with respect to the zipper chain.

The additional safety switch locks the drive 50 into place to add a further layer of safety.

An advantage of the illustrated embodiments of the disclosed zipper lock is that the locking member is internal to a receptacle to which the lock is engaged. This inhibits breaking of the lock. Moreover because the locking member is biased into the locked configuration, locking the zipper is automatic, making use of the lock easier and less likely to fail for user inactivity.

Turning now to FIGS. 8-16, disclosed is a lock 101 for a zipper (not illustrated). The lock 101 is adapted to retain a slider (not illustrated) in relation to a chain (not illustrated) of the zipper in order to maintain the zipper in a closed configuration until the lock 101 is actuated for opening. The lock is particularly useful in applications in which the zipper is designed to close a receptacle such as a bag, an envelope or a box.

The lock 101 comprises a lock body 103 and a locking member 104. In the illustrated form the lock body 103 comprises a chassis 106 defining an internal cavity 107. A cover 108 is configured and shaped to fit over the chassis and further define the internal cavity 107. An actuation assembly 109 extends through and is supported by the chassis 106 and/or a base 61. In this illustrated form the actuation assembly is in the form of an elongate member 110 extending in a U shaped configuration and engageable with the locking member 104.

The lock body further comprises two actuator buttons 112 which are configured to be positioned to extend through the cover 108 or through a space between the cover and the base 111. The buttons 112 engage with the actuation assembly 59 such that movement of the buttons actuates movement of the actuation assembly.

The actuator buttons 112 are outwardly biased by a spring 114 or plurality of springs extending between them.

Chassis 106 includes a slots 116 in its (in use) outwardly facing surface. The slots 116 includes a longitudinally extending slot 118 and two side extensions 119. The slot 116 is sized and shaped such that in use lugs (not illustrated in this form) extending inwardly (in use) from the actuator buttons 112 can be located in the slot 116. The lugs are located in the side extensions 119 when the actuator buttons are released and move into the longitudinally extending slot 118 when the actuator buttons 112 are pressed.

This provides for safety from accidental opening for example by a child. When the lugs 117 face into and are located in the side extensions 119, the actuator assembly 109 cannot be moved longitudinally with respect to the lock (to release or open the lock) Once the actuator buttons 112 are pressed in, the lugs align in the longitudinally extending slot 118 allowing the actuator assembly 119 to be moved. The actuator buttons 112 engage with the actuator assembly 119 through a drive 121. In the illustrated form the drive 121 comprises a button engagement section 122 which engages the actuator buttons and an actuator assembly engagement section 123 which engages the actuator assembly 119. The drive 121 is slideable in a drive slot 124 which extends into the chassis 106.

The actuator assembly 119 comprises arms 115 and an adjoining web 117. The actuator assembly 119 acts as the unlocking member and is configured to engage with and act upon the locking member 104.

The locking member 104 is rotatably supported by a lock pin. In the illustrated form the locking member 104 extends between the arms 115. The locking member 104 is in the form of a rotatable shoulder 132. The shoulder 132 is rotatable between an upstanding position which forms the retaining position of the lock. The shoulder 132 is biased into this retaining position by a spring 133.

The shoulder 132 is moveable into a releasing position in which the shoulder is positioned proximally to the base 111 rather than in an upstanding position.

In use, a zipper is located within the lock 101 such that a terminal portion of the chain is located in the internal cavity. The chain is retained in position by the chassis 106. A zipper slider portion of the zipper is moveable into the internal cavity 107. When the zipper slider is positioned in the internal cavity 107 the zipper is in a closed configuration.

The locking member 104 of lock 101 is biased into an upstanding position in which the slider is retained in position within the lock 101. In use, a pull tag (not illustrated) of the slider is positioned and accessible within the internal cavity 107. However the locking member 104 precludes movement of the slider in response to pulling the pull tab until the lock is unlocked.

Actuation of the lock 101 by pressing the buttons 112 inwardly and moving them away from the cavity 107 to effect movement of the actuator assembly 119, results in movement of the lock member 104 into a releasing position in which the zipper slider is moveable with respect to the chain to open the zipper.

In the illustrated form, the retaining position of the locking member 104 is such that the slider cannot move from the lock 101 because a surface of the slider cannot be moved past the shoulder 132. The shoulder 132 thus abuts a surface of the slider, preventing motion. Specifically the shoulder in the illustrated form abuts a surface of the slider in an opposing relationship with the pull tab.

In use on a receptacle, the locking member 104 is positioned internal to the receptacle. As a result the locking member abuts an internal side of the slider.

Figure 17:
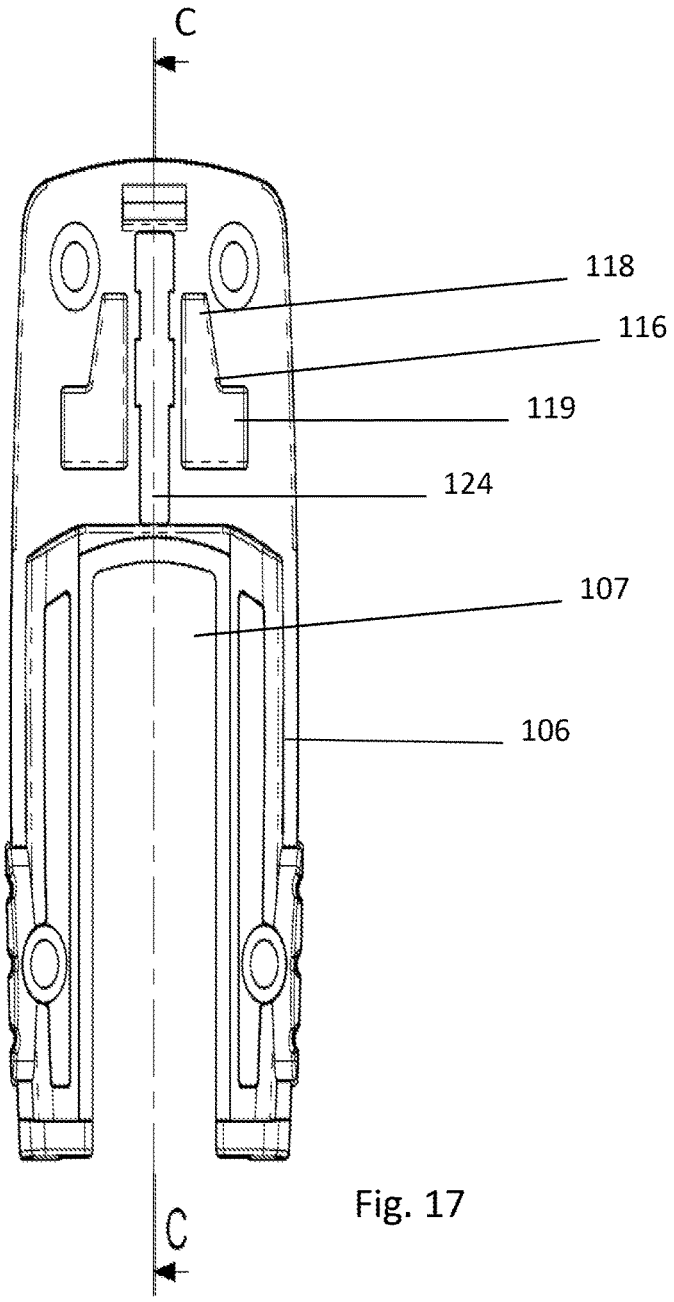
FIG. 17 is a view of the chassis of one form of the lock.
Figure 18:
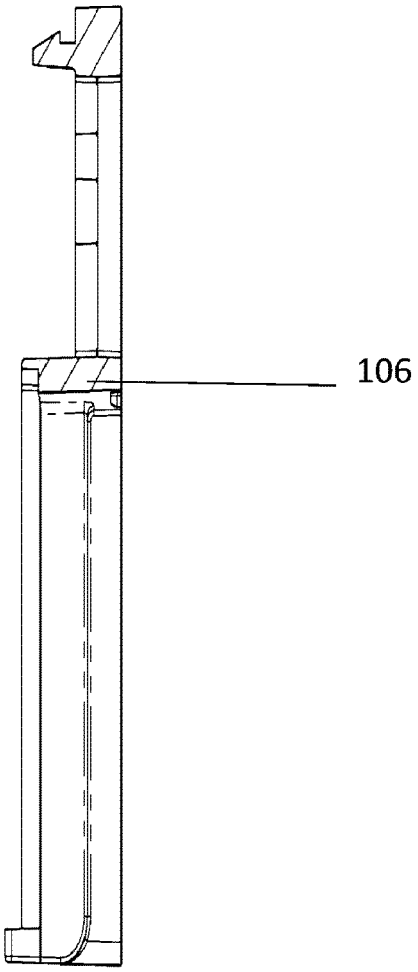
FIG. 18 is a side view of the chassis of FIG. 17.
Figure 19:
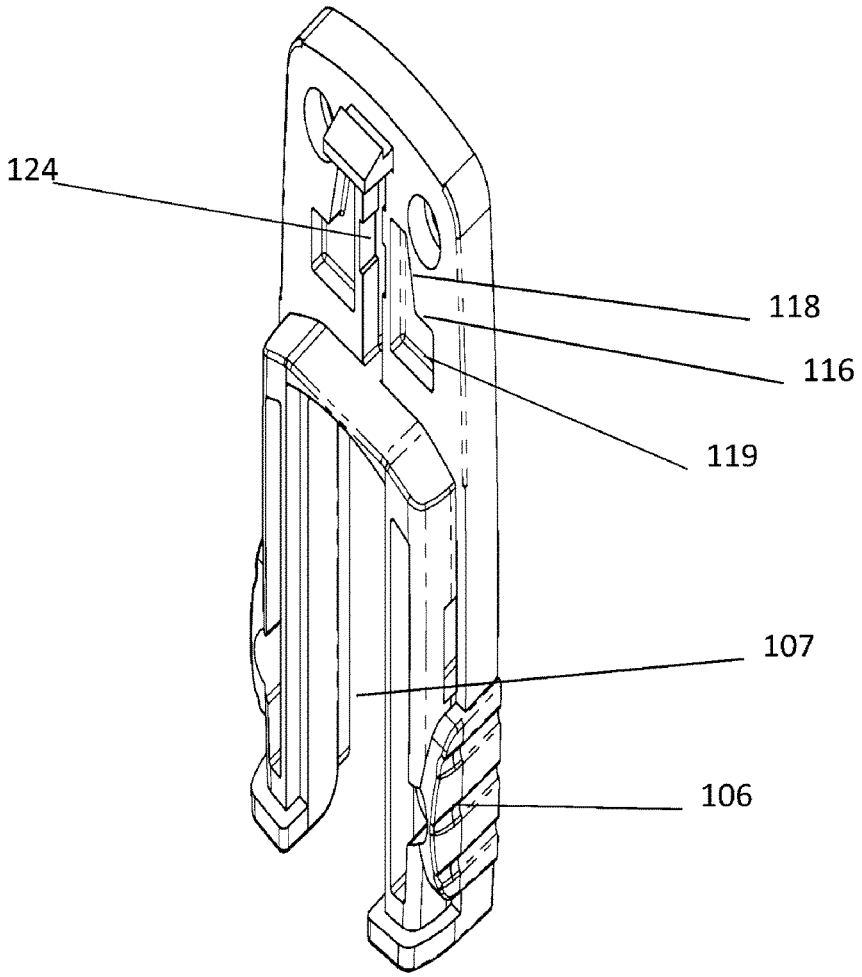
FIG. 19 is a perspective view of the chassis of FIG. 17.

Turning now to FIGS. 17-19, the chassis 106 is shown. The chassis 106 defines a cavity 107 in which the zipper slider (not illustrated) is positioned. The chassis 106 further includes slots 116 into which lugs or similar projections extending from the actuator buttons 112 are positioned in use. The slots 116 include a longitudinally extending portion 118 and a side portion 119.

Referring to FIGS. 20-22, the actuator buttons 112 include lugs 117 which in this form extend inwardly when the lock is in position in use. The lugs 117 are adapted to engage slots 116.

Figure 23:
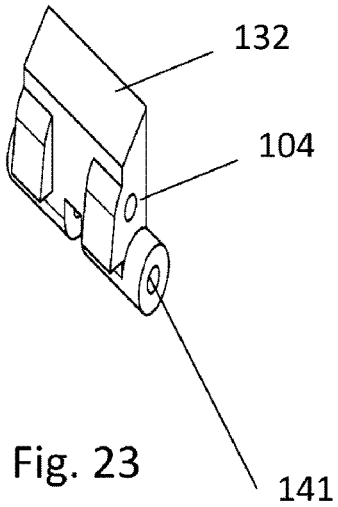
FIG. 23 is a perspective view of a locking member for a lock.
Figure 24:
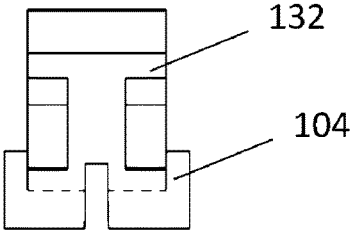
FIG. 24 is a front view of the locking member of FIG. 23.
Figure 25:
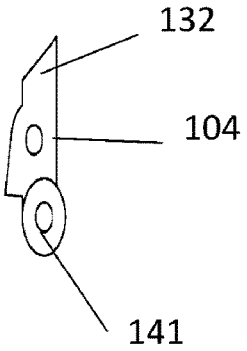
FIG. 25 is a side view of the locking member of FIG. 23.

Turning now to FIGS. 23-25, the locking member 104 comprises a shoulder 132. The locking member 104 is rotatable about an axis extending through a through cavity 141. In the illustrated form, a pin extends through the through cavity 141.

The locking member 104 is rotatable between an upstanding position as shown in FIG. 7 which forms the retaining position and a release position in which the shoulder extends substantially parallel with or aligned to the base (not illustrated in this figure). The shoulder 132 is biased into the retaining position by a spring (not illustrated in this figure).

Figure 26:
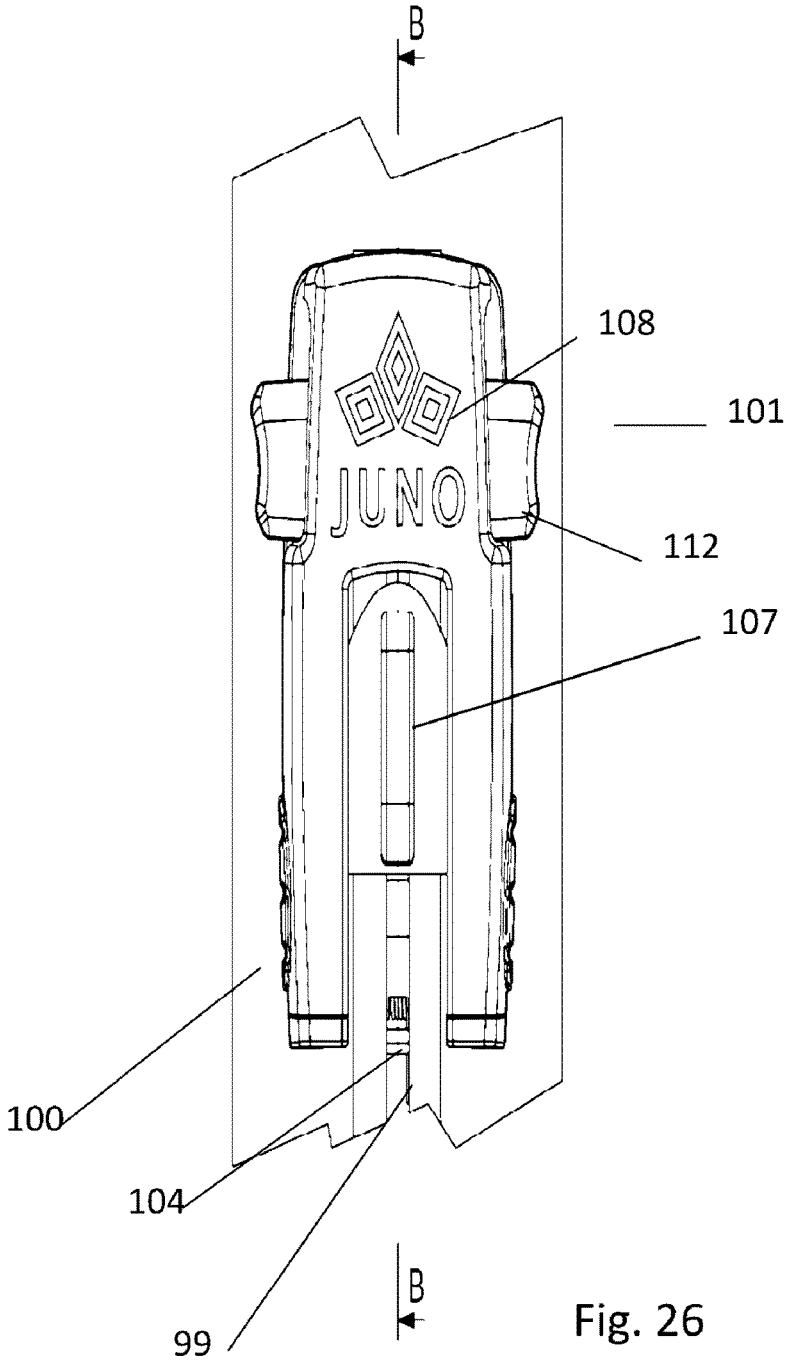
FIG. 26 is a top view of a third embodiment of a lock in use in the retaining configuration.
Figure 27:
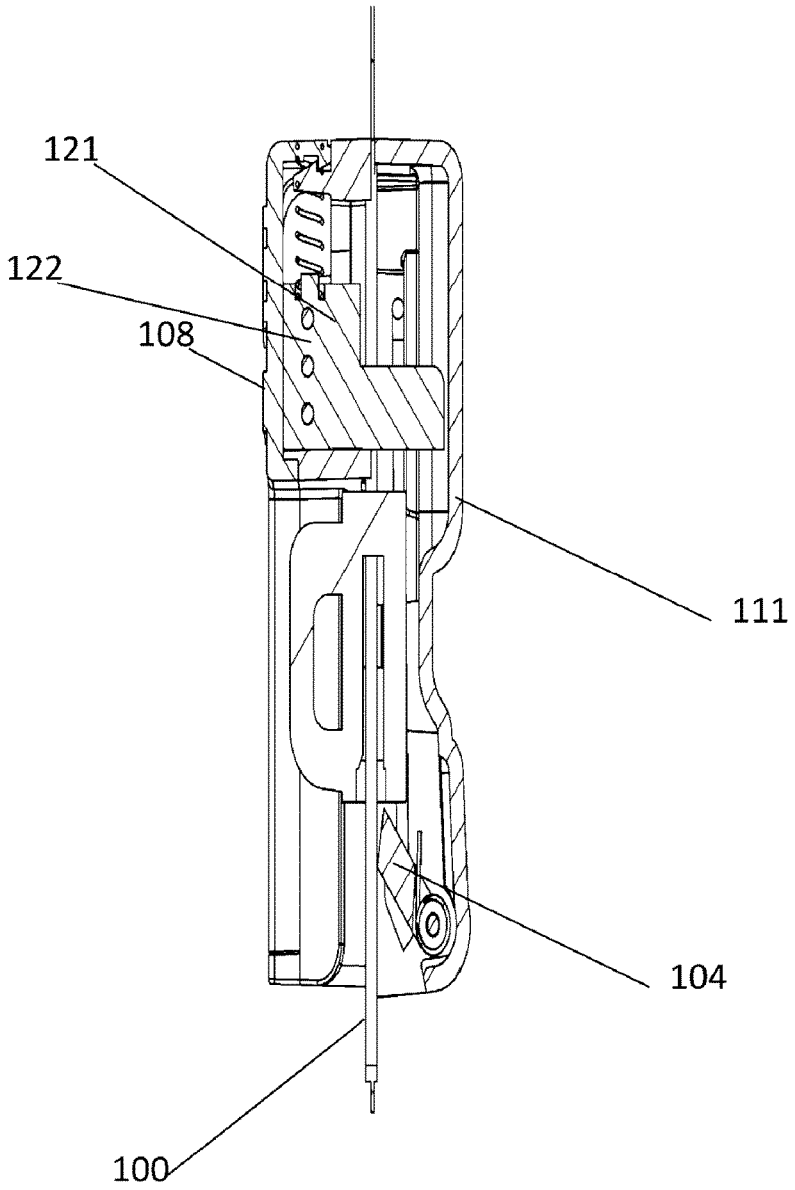
FIG. 27 is a cross sectional view through B-B of the lock of FIG. 26.
Figure 28:
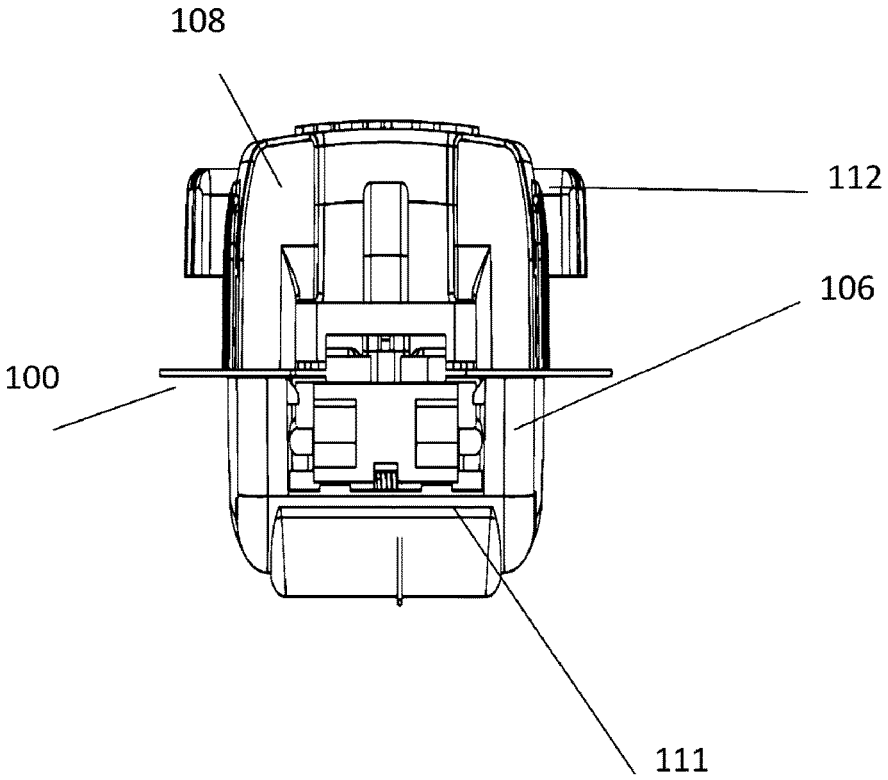
FIG. 28 is an end view of the lock of FIG. 26.
Figure 29:
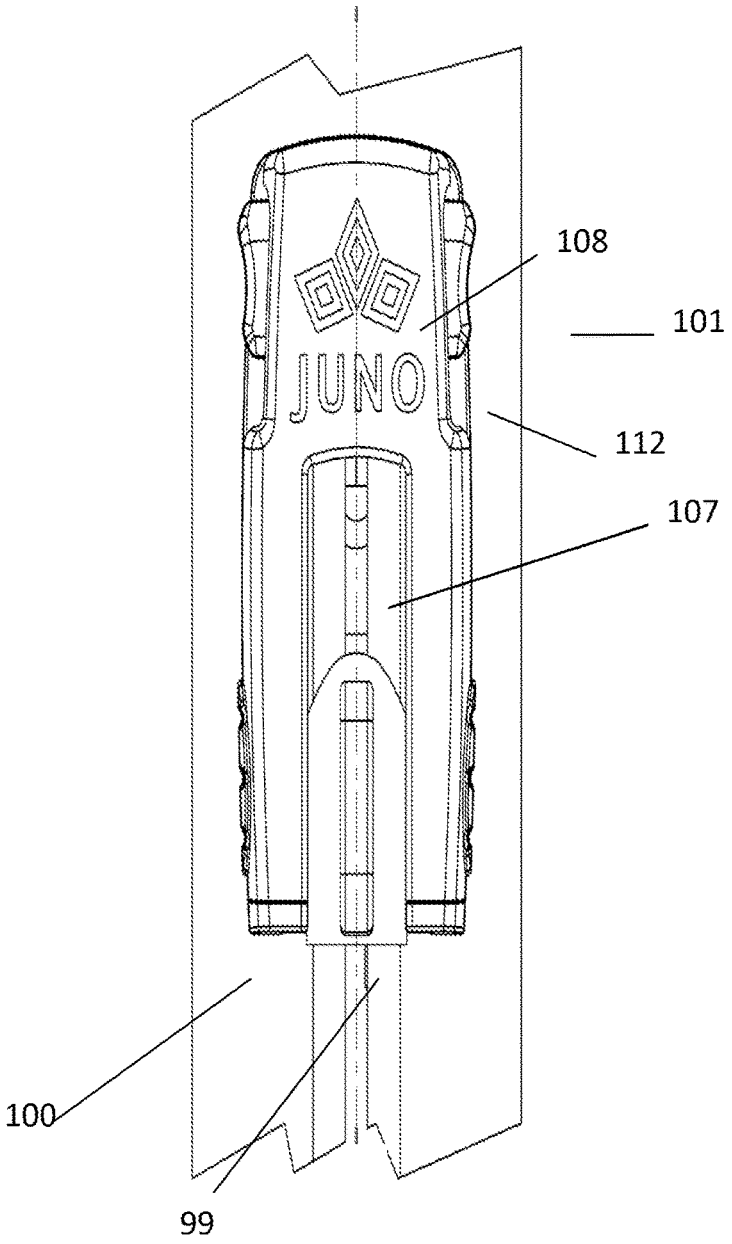
FIG. 29 is a top view of the lock of FIG. 26 in the releasing configuration.
Figure 30:
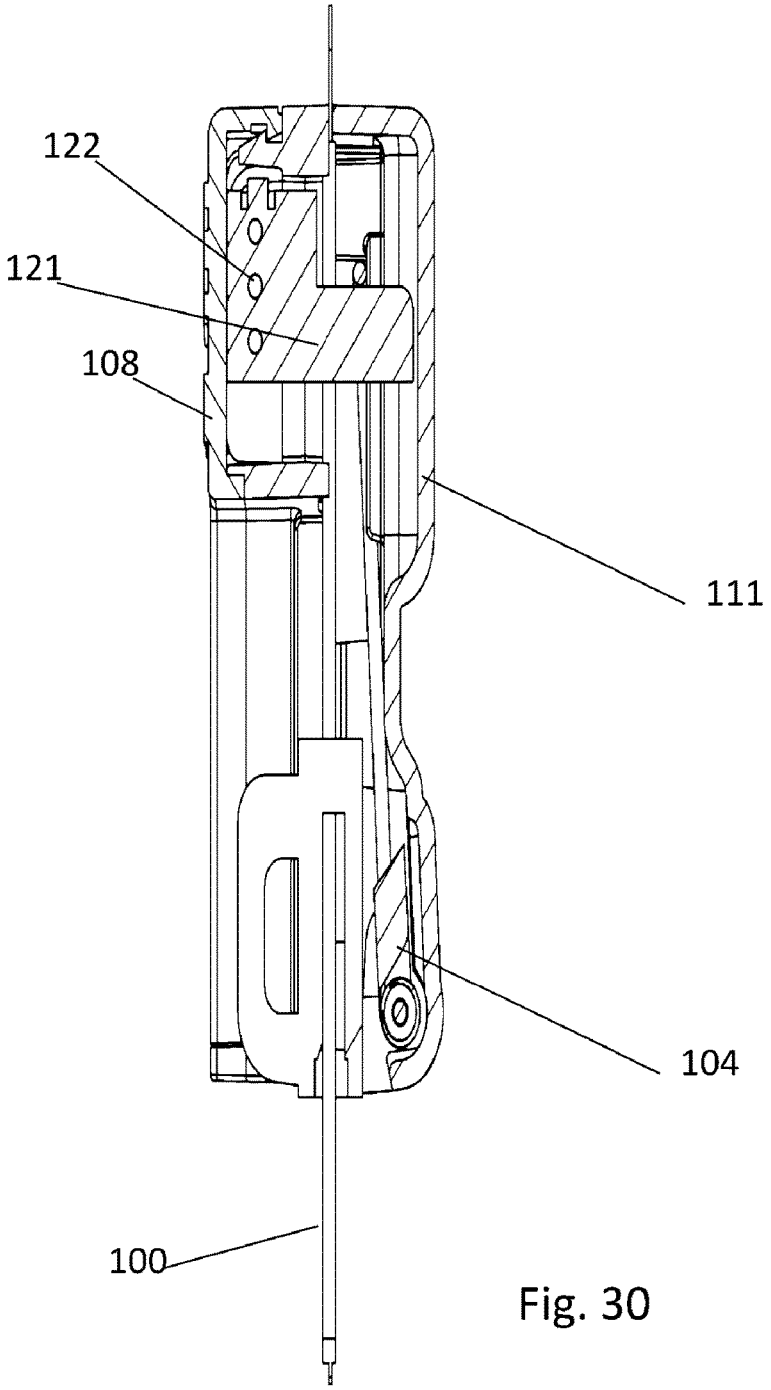
FIG. 30 is a cross-sectional view through B-B of the lock of FIG. 26 in the releasing configuration.
Figure 31:
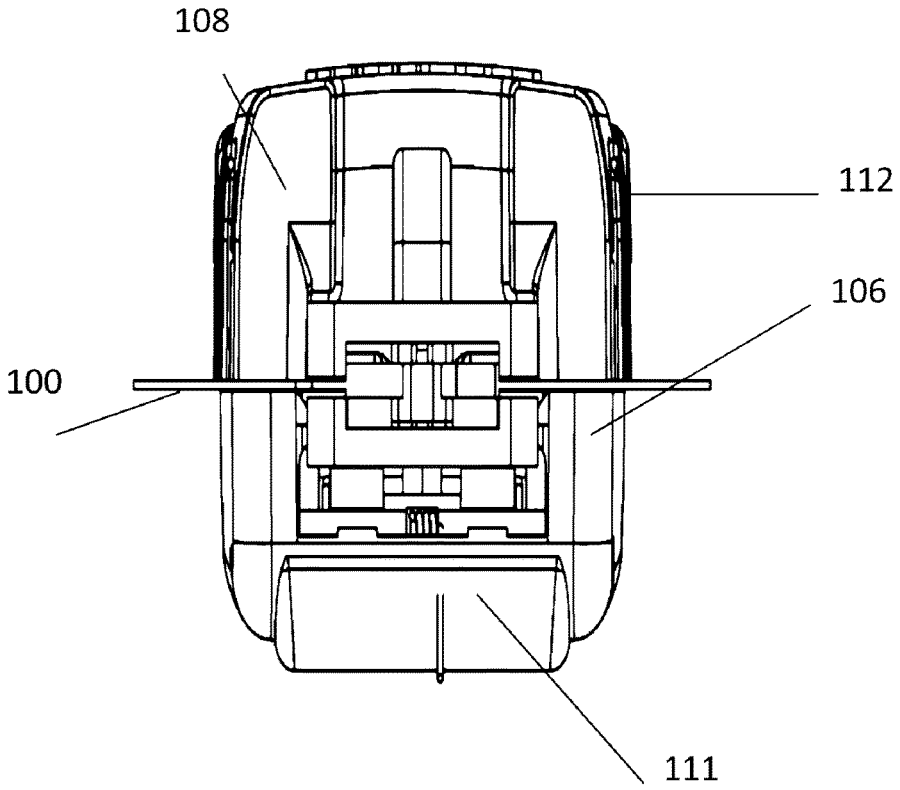
FIG. 31 is an end view of the lock of FIG. 26 in the releasing configuration.

Turning to FIGS. 26-31, the lock 101 is shown in use with a receptacle 100 and zipper 99. The receptacle could be in the form of a bag or box or other zippable container. In use, the zipper 99 is positioned within the lock such that the pull tab of the slider (not illustrated) is positioned in and can extend from the internal cavity. As shown in FIGS. 26-28, the locking member 104 is biased into an upstanding position in which movement of the slider is prevented by contact between a surface of the slider facing away from the pull tab and the shoulder 132 of the locking member 104.

Actuation of the actuators 112 and movement of those actuator buttons away from the locking member results in the actuating member 119 compelling movement of the shoulder 132 into the release position to allow the slider to move with respect to the zipper chain.

While specific embodiments of the lock have been described, it will be clear to someone skilled in art that alternative shapes and configurations of the lock are available to provide a zipper lock.

Specifically, the actuator shape could be varied while still maintaining a childproof or child safety configuration for unlocking. Moreover the locking member could be in alternative forms while still being moveable to directly or indirectly retain the slider with respect to the chain.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and modifications may be made to the parts previously described without departing from the spirit or ambit of the invention.

The invention claimed is:

1. A locking system for a zipper, the zipper comprising a chain and a slider, the chain being moveable to adopt an open and a closed configuration through movement of the slider with respect to the chain, the zipper comprising a pull tab engaged with the slider for effecting movement of the slider with respect to the chain, the slider having opposing sides which are in contact with the chain in use and opposing faces which are oriented substantially normal to the sides and facing away from one another, the pull tab being engaged with one of the faces of the slider, the opposing face comprising an abutment face, the locking system including a lock member biased into a retaining position in which the lock member retains the slider with respect to the chain by abutting at least a portion of the abutment face of the slider, the locking system including an actuator such that actuation of the actuator allows movement of the lock member into a releasing position.

2. A locking system for a zipper as defined in claim 1, wherein the lock member is hingedly moveable between the retaining position and the releasing position.

3. A locking system for a zipper as defined in claim 1, wherein the actuator comprises a child-safe actuator.

4. A locking system for a zipper as defined in claim 1, wherein the actuator requires compression of multiple actuator portions to result in movement of the lock member between the retaining position and the releasing position.

5. A locking system for a zipper as defined in claim 1, wherein the abutment face faces substantially perpendicular to the direction of movement of the slider.

6. A locking system for a zipper as defined in claim 1, the locking system being adapted for use with a zippable receptacle having an inside and an outside, the slider being positioned such that the abutment face of the slider faces inwardly with respect to the receptacle, such that when the receptacle is in a closed configuration, the lock member is located inside the receptacle.

7. A locking system for a zipper as defined in claim 1, the zipper being adapted to close a receptacle, the lock system comprising a lock member positioned in use in the interior of the receptacle such that when the receptacle is closed the lock member cannot be reached from outside the receptacle.

8. A receptacle having a zipper adapted to close the receptacle and a zipper locking system, the zipper comprising a chain and a slider, the chain being moveable to adopt an open and a closed configuration through movement of the slider with respect to the chain, the zipper comprising a pull tab engaged with the slider for effecting movement of the slider with respect to the chain, the slider having opposing sides which are in contact with the chain in use and opposing faces which are oriented substantially normal to the sides and facing away from one another, the pull tab being engaged with one of the faces of the slider, the opposing face comprising an abutment face, and the locking system including a lock member biased into a retaining position in which the lock member retains the slider with respect to the chain by abutting at least a portion of the abutment face of the slider, the locking system including an actuator such that actuation of the actuator allows movement of the lock member into a releasing position.

9. A receptacle as defined in claim 8, wherein the lock comprises a shoulder which is moveable between a retaining position in which the shoulder is configured to abut a surface of the slider and a releasing position.

10. A receptacle as defined in claim 9, wherein movement between the retaining position and the releasing position is effected by an actuator.

11. A receptacle as defined in claim 8, wherein the receptacle is a bag for carrying medication.

12. A receptacle as defined in claim 11, wherein the receptacle is sized for fitting within a carry bag, hand bag, back pack or other bag.

13. A locking system as defined in claim 1, the locking system being able to be locked and unlocked multiple times without replacing a portion of the locking system.

14. A locking system as defined in claim 1, wherein the actuator is located separately from the lock member.

* * * * *